US008708468B2

(12) United States Patent
Suzuki et al.

(10) Patent No.: US 8,708,468 B2
(45) **Date of Patent: *Apr. 29, 2014**

(54) IMAGE FORMING APPARATUS INCLUDING RECORDING HEAD FOR EJECTING LIQUID DROPLETS

(75) Inventors: Michiharu Suzuki, Kanagawa (JP); Junji Seto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/440,042

(22) Filed: Apr. 5, 2012

(65) Prior Publication Data

US 2012/0287202 A1 Nov. 15, 2012

(30) Foreign Application Priority Data

May 10, 2011 (JP) ..... 2011-104824

(51) Int. Cl.
*B41J 2/175* (2006.01)

(52) U.S. Cl.
USPC ..... 347/86; 347/84; 347/85

(58) Field of Classification Search
USPC ..... 347/84–87
See application file for complete search history.

(56) References Cited

U.S. PATENT DOCUMENTS

| | | | |
|---|---|---|---|
| 2004/0001126 | A1 | 1/2004 | Oda et al. |
| 2005/0053502 | A1 | 3/2005 | Souza |
| 2007/0024681 | A1 | 2/2007 | Umeda |
| 2009/0315943 | A1 | 12/2009 | Ohnishi et al. |
| 2010/0165040 | A1 | 7/2010 | Ohnishi et al. |
| 2010/0253717 | A1 | 10/2010 | Suzuki |

FOREIGN PATENT DOCUMENTS

| | | |
|---|---|---|
| CN | 1456439 | 11/2003 |
| CN | 1467089 | 1/2004 |
| CN | 1923514 | 3/2007 |
| JP | 2003-145802 | 5/2003 |
| JP | 2003-148564 | 5/2003 |
| JP | 2004-299098 | 10/2004 |
| JP | 2005-144711 | 6/2005 |
| JP | 3926594 | 6/2007 |
| JP | 2010-64464 | 3/2010 |

OTHER PUBLICATIONS

European Search Report dated Feb. 6, 2013 in corresponding European patent application No. 12 16 4459.5.
Chinese official action dated Feb. 8, 2014 in corresponding. Chinese patent application No. 2012 10 14 2782.3.

*Primary Examiner* — Justin Seo
(74) *Attorney, Agent, or Firm* — Cooper & Dunham LLP

(57) ABSTRACT

An image forming apparatus includes a recording head, head tanks, replaceable main tanks, liquid feed pumps, a first driving source, and a drive switching assembly. The feed pumps feed liquids from the main tanks to the head tanks and in reverse from the head tanks to the main tanks. The drive switching assembly selectively transmits a driving force of the first driving source to the feed pumps. The drive switching assembly includes a second driving source, a cam, a slider member, and a switching gear. The switching gear receives the driving force of the first driving source and is movable with the slider member between positions to engage driving gears of the feed pumps and a position to disengage from the driving gears. With movement of the switching gear, the driving force of the first driving source is selectively transmitted to the feed pumps.

10 Claims, 15 Drawing Sheets

IMAGE FORMING APPARATUS INCLUDING RECORDING HEAD FOR EJECTING LIQUID DROPLETS

CROSS-REFERENCE TO RELATED APPLICATION

This patent application is based on and claims priority pursuant to 35 U.S.C. §119 to Japanese Patent Application No. 2011-104824, filed on May 10, 2011, in the Japan Patent Office, the entire disclosure of which is hereby incorporated by reference herein.

BACKGROUND

1. Technical Field

This disclosure relates to an image forming apparatus, and more specifically to an image forming apparatus including a recording head for ejecting liquid droplets.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink.

Such an image forming apparatus may have, for example, replaceable main tanks (ink cartridges) and head tanks. The main tanks store different color inks to be supplied to one or more recording heads for ejecting ink droplets of different colors. The head tanks dedicated for the respective color inks receive the color inks from the main tanks and supply the inks to the recording heads.

Such an image forming apparatus may also have a maintenance unit to maintain and recover the performance of the recording heads. The maintenance unit typically has suction caps to cover the nozzle faces of the recording heads and a suction pump connected to the suction caps to suck ink from nozzles of the recording heads.

Furthermore, such an image forming apparatus may have an air release unit and an air release driving unit. The air release unit is disposed at the head tank and openable to release air from the interior of the head tank to the atmosphere. The air release driving unit is disposed at a main unit of the apparatus to drive the air release unit.

In a case where such an image forming apparatus has multiple pumps, such as liquid feed pumps and the suction pump, if multiple driving motors are provided as dedicated driving sources for driving the respective pumps, the image forming apparatus increases in size and cost.

Hence, for example, JP2003-145802-A proposes an image forming apparatus having a sun gear, a planet gear, pump driving gears, and a revolution regulation unit to selectively drive three or more pumps with a single driving source. The sun gear is rotated in first and second directions by the rotation drive force of a selective driving mechanism. The planet gear revolves around the sun gear with rotation of the sun gear and rotates on its axis with rotation of the sun gear when the revolution is restricted. The pump driving gears are arranged along the revolution trajectory of the planet gear to in turn engage the planet gear when the planet gear revolves with the rotation of the sun gear in the first direction. The revolution regulation unit restricts the revolution of the planet gear performed with the rotation of the sun gear in the second direction, at positions where the planet gear engages the pump driving gears.

However, the above-described configuration poses difficulty in activating the pumps independent of one another, as compared to a configuration in which dedicated driving sources for the respective pumps are employed. In addition, since the driving (rotation) direction of the pumps is limited to one direction, the above-described configuration has difficulty in applying to, e.g., a case where liquid feed pumps for feeding liquid in both directions are used.

BRIEF SUMMARY

In an aspect of this disclosure, there is provided an image forming apparatus including a recording head, a plurality of head tanks, a plurality of replaceable main tanks, a plurality of liquid feed pumps, a first driving source, and a drive switching assembly. The recording head ejects droplets of liquids. The plurality of head tanks supplies the liquids to the recording head. The plurality of replaceable main tanks stores the liquids to be supplied to the recording head. The plurality of liquid feed pumps feeds the liquids from the plurality of main tanks to the plurality of head tanks and in reverse from the plurality of head tanks to the plurality of main tanks. The first driving source drives the plurality of liquid feed pumps. The drive switching assembly selectively transmits a driving force of the first driving source to the plurality of liquid feed pumps. The drive switching assembly includes a second driving source, a cam, a slider member, and a switching gear. The cam is rotated by the second driving source. The slider member is movable in a thrust direction with rotation of the cam. The switching gear receives the driving force of the first driving source and is movable with the slider member between positions to engage driving gears of the plurality of liquid feed pumps and a position to disengage from the driving gears of the plurality of liquid feed pumps. With movement of the switching gear, the driving force of the first driving source is selectively transmitted to the plurality of liquid feed pumps.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
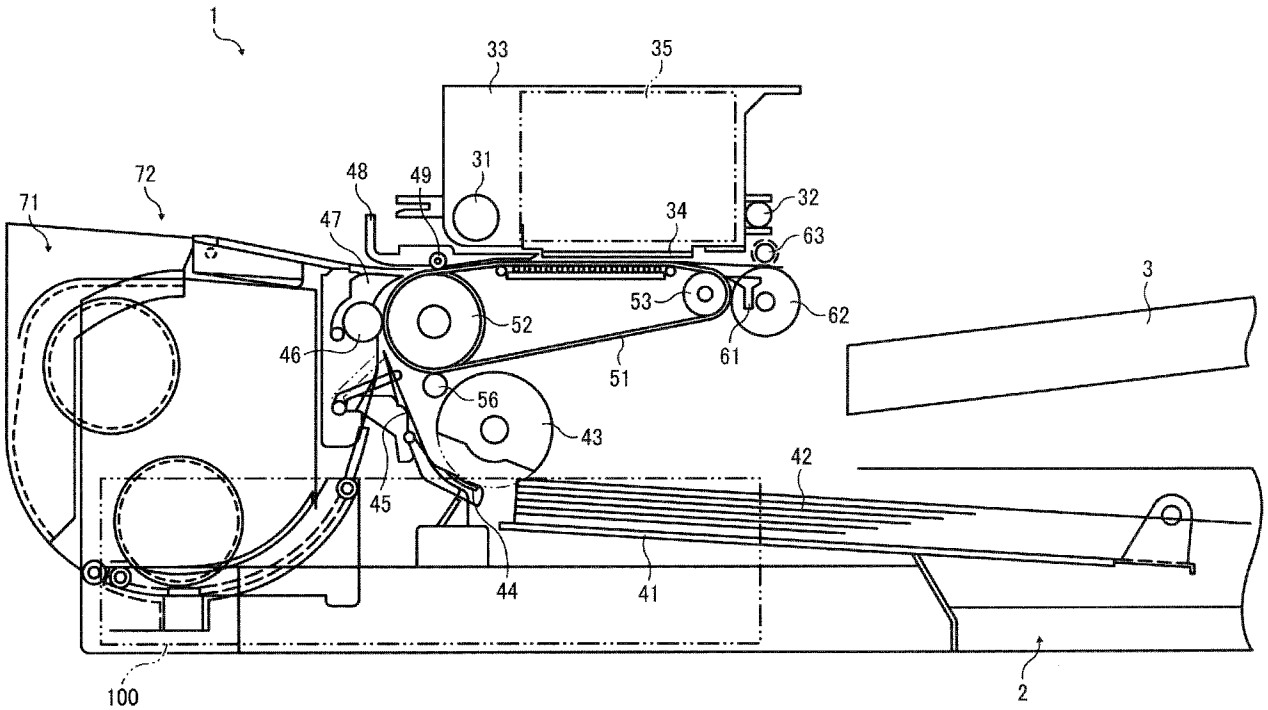
FIG. 1 is a schematic side view of a mechanical section of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "sheet" used herein is not limited to a sheet of paper but includes, e.g., an OHP (overhead projector) sheet, a cloth sheet, a grass sheet, a substrate, or anything on which droplets of ink or other liquid can adhere. In other words, the term "sheet" is used as a generic term including a recording medium, a recorded medium, a recording sheet, or a recording sheet of paper. The term "image forming apparatus" refers to an apparatus that ejects ink or any other liquid onto a medium to form images on the medium. The medium is made of, for example, paper, string, fiber, cloth, leather, metal, plastic, glass, timber, and ceramic. The term "image formation", which is used herein as a synonym for "recording" or "printing", includes providing not only meaningful images, such as characters and figures, but meaningless images, such as patterns, to the medium (in other words, the term "image formation" includes only causing liquid droplets to land on the medium).

The term "ink" as used herein is not limited to "ink" in a narrow sense unless specifically distinguished and includes any types of liquid useable for image formation, such as recording liquid, fixing solution, DNA sample, resist, pattern material, and resin. The term "image" used herein is not limited to a two-dimensional image and includes, for example, an image applied to a three dimensional object and a three dimensional object itself formed as a three-dimensionally molded image. The term "image forming apparatus" includes e.g., both a serial-type image forming apparatus and a line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment of this disclosure is described with reference to FIGS. 1 and 2.

FIG. 1 is a side view of an entire configuration of the image forming apparatus. FIG. 2 is a partial plan view of the image forming apparatus. In this exemplary embodiment, the image forming apparatus is described as a serial-type inkjet recording apparatus. It is to be noted that the image forming apparatus is not limited to such a serial-type inkjet recording apparatus and may be any other type image forming apparatus.

Figure 2:
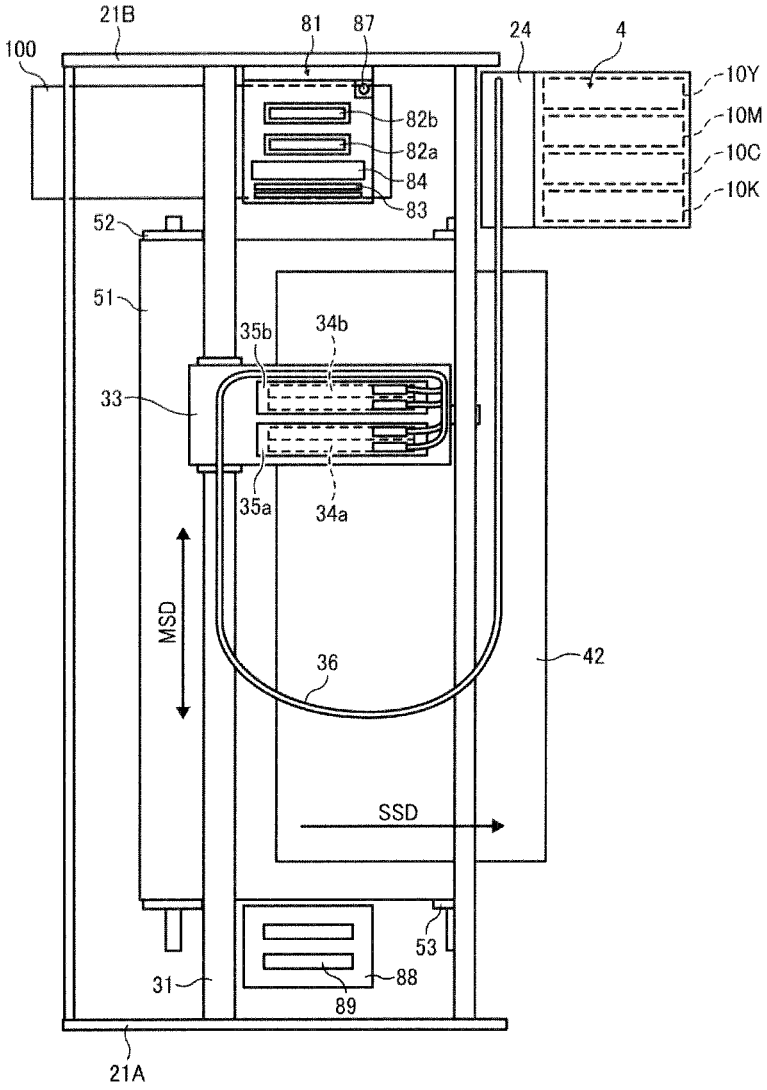
FIG. 2 is a plan view of the mechanical section of the image forming apparatus illustrated in FIG. 1.

In the image forming apparatus, a carriage 33 is supported on a main guide rod 31 and a sub guide rod 32 so as to be slidable in a direction (main scanning direction) indicated by an arrow MSD in FIG. 2. The main guide rod 31 and the sub guide rod 32 serving as guide members extend between a left-side plate 21A and a right-side plate 21B standing on a main unit 1. The carriage 33 is reciprocally moved in the main scanning direction by a main scan motor and a timing belt.

On the carriage 33 are mounted recording heads 34*a* and 34*b* (collectively referred to as "recording heads 34" unless distinguished) serving as liquid ejection heads for ejecting ink droplets of different colors, e.g., yellow (Y), cyan (C), magenta (M), and black (K). The recording heads 34*a* and 34*b* are mounted on the carriage 33 so that nozzle rows of multiple nozzles are arranged in a direction (sub-scanning direction) perpendicular to the main scanning direction and ink droplets are ejected downward from the nozzles.

For example, each of the recording heads 34 has two nozzle rows. In such a case, for example, one of the nozzle rows of the recording head 34*a* ejects droplets of black (K) ink and the other ejects droplets of cyan (C) ink. In addition, one of the nozzle rows of the recording head 34*b* ejects droplets of magenta (M) ink and the other ejects droplets of yellow (Y) ink.

On the carriage 33 are mounted head tanks 35*a* and 35*b* (collectively referred to as "head tanks 35" unless distinguished) for supplying the corresponding color inks to the respective nozzle rows. A supply pump unit 24 supplies (replenishes) respective color inks from ink cartridges 10Y, 10M, 10C, and 10K to the head tanks 35 via ink supply tubes 36 dedicated for the respective color inks. The ink cartridges 10Y, 10M, 10C, and 10K are removably mountable to a cartridge mount portion 4.

The image forming apparatus further includes a sheet feed section to feed sheets 42 stacked on a sheet stack portion (platen) 41 of a sheet feed tray 2. The sheet feed section further includes a sheet feed roller 43 of, e.g., a half moon shape to separate the sheets 42 from the sheet stack portion 41 and feed the sheets 42 sheet by sheet, and a separation pad 44 disposed facing the sheet feed roller 43. The separation pad 44 is made of a material of a high friction coefficient and biased (urged) toward the sheet feed roller 43.

To feed the sheet 42 from the sheet feed section to an area below the recording heads 34, the image forming apparatus includes a first guide member 45 to guide the sheet 42, a counter roller 46, a conveyance guide member 47, a regulation member 48 including a front-end guide roller 49, and a conveyance belt 51 to convey the sheet 42 to a position facing the recording head 34 with the sheet 42 electrostatically adhered thereon.

The conveyance belt 51 is an endless belt that is looped between a conveyance roller 52 and a tension roller 53 so as to circulate in a belt conveyance direction, that is, the sub-scanning direction (SSD). A charging roller 56 is provided to charge a surface of the conveyance belt 51. The charging roller 56 is disposed so as to contact the surface of the conveyance belt 51 and rotate with the circulation of the conveyance belt 51. When the conveyance roller 52 is rotated by a sub-scanning motor via a timing roller, the conveyance belt 51 circulates in the sub-scanning direction SSD (belt conveyance direction) illustrated in FIG. 2.

The image forming apparatus further includes a sheet output section to output the sheet 42 on which an image has been formed by the recording heads 34. The sheet output section includes a separation claw 61 to separate the sheet 42 from the conveyance belt 51, a first output roller 62, a second output roller 63, and a sheet output tray 3 disposed below the first output roller 62.

A duplex unit 71 is removably mounted on a rear portion of the main unit 1. When the conveyance belt 51 rotates in reverse to return the sheet 42, the duplex unit 71 receives the sheet 42. Then the duplex unit 71 turns the sheet 42 upside down to feed the sheet 42 between the counter roller 46 and the conveyance belt 51. At the top face of the duplex unit 71 is formed a manual-feed tray 72.

As illustrated in FIG. 2, a maintenance unit 81 is disposed at a non-printing area (non-recording area) that is located on one end in the main-scanning direction of the carriage 33. The maintenance unit 81 maintains and recovers nozzle conditions of the recording heads 34. The maintenance unit 81 includes caps 82*a* and 82*b* (hereinafter collectively referred to as "caps 82" unless distinguished) to cover the nozzle faces of the recording heads 34, a wiper member (wiper blade) 83 to wipe the nozzle faces of the recording heads 34, a first droplet receptacle 84 to receive ink droplets ejected by maintenance ejection in which ink droplets are ejected not for image formation but for maintenance, e.g., removal of increased-viscosity ink, and a carriage lock 87 to lock the carriage 33. Below the maintenance unit 81, a waste liquid tank 100 is removably mounted to the main unit 1 to store waste ink or liquid generated by the maintenance and recovery operation.

A second droplet receptacle 88 is disposed at a non-recording area on the opposite end in the main-scanning direction of the carriage 33. The second droplet receptacle 88 receives ink droplets ejected by the maintenance ejection during, e.g., recording (image forming) operation. The second droplet receptacle 88 has openings 89 arranged in parallel with the nozzle rows of the recording heads 34.

In the image forming apparatus having the above-described configuration, the sheet 42 is separated sheet by sheet from the sheet feed tray 2, fed in a substantially vertically upward direction, guided along the first guide member 45, and conveyed between the conveyance belt 51 and the counter roller 46. Further, the front tip of the sheet 42 is guided with a conveyance guide 37 and pressed against the conveyance belt 51 by the front-end guide roller 49 to turn the traveling direction of the sheet 42 by approximately 90°.

At this time, plus outputs and minus outputs, i.e., positive and negative supply voltages are alternately applied to the charging roller 56 so that the conveyance belt 51 is charged with an alternating voltage pattern, that is, an alternating band pattern of positively-charged areas and negatively-charged areas in the sub-scanning direction SSD, i.e., the belt circulation direction. When the sheet 42 is fed onto the conveyance belt 51 alternately charged with positive and negative charges, the sheet 42 is adhered to the conveyance belt 51 and conveyed in the sub scanning direction by circulation of the conveyance belt 51.

By driving the recording heads 34 in response to image signals while moving the carriage 33, ink droplets are ejected onto the sheet 42, which is stopped below the recording heads 34, to form one band of a desired image. Then, the sheet 42 is fed by a certain distance to prepare for the next operation to record another band of the image. Receiving a signal indicating that the image has been recorded or the rear end of the sheet 42 has arrived at the recording area, the recording heads 34 finish the recording operation and the sheet 42 is output to the sheet output tray 3.

To perform maintenance-and-recovery operation of the nozzles of the recording heads 34, the carriage 33 is moved to a home position at which the carriage 33 opposes the maintenance unit 81. Then, maintenance-and-recovery operation, such as nozzle suction operation for sucking ink from nozzles with the nozzle faces of the recording heads 34 covered with the caps 82 and/or maintenance ejection for ejecting droplets of ink not contributed to image formation, is performed, thus allowing image formation with stable droplet ejection.

Next, an example of the head tank is described with reference to FIGS. 3 and 4.

Figure 3:
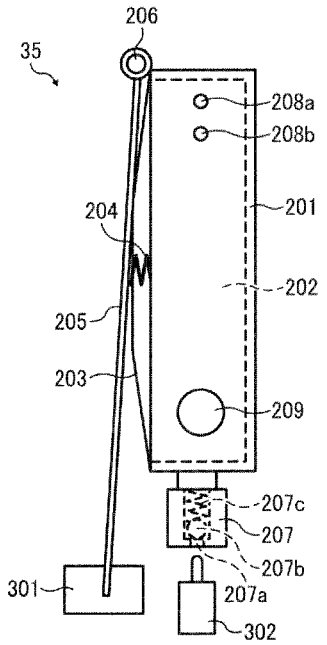
FIG. 3 is a schematic plan view of an example of a head tank of the image forming apparatus.
Figure 4:
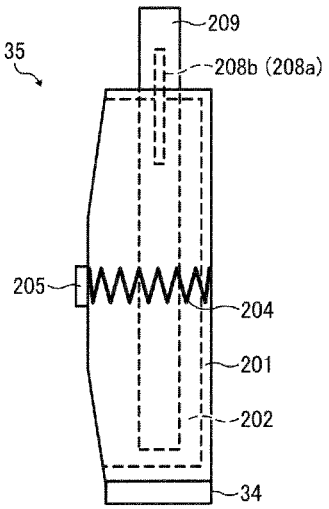
FIG. 4 is a schematic front view of the head tank illustrated in FIG. 3.

FIG. 3 is a schematic plan view of an example of the head tank 35. FIG. 4 is a schematic front view of the head tank 35 illustrated in FIG. 3.

The head tank 35 has a tank case 201 forming an ink accommodation part 202 to accommodate ink and having an opening at one side. The opening of the tank case 201 is sealed with a flexible film 203, and a spring 204 serving as an elastic member is disposed in the tank case 201 to constantly urge the flexible film 203 outward. Since the outward urging force of the spring 204 constantly acts on the flexible film 203 of the tank case 201, a reduction in the remaining amount of ink in the tank case 201 creates a negative pressure in the tank case 201.

At the exterior of the tank case 201, a detection filler 205 serving as a displacement member is fixed on the flexible film 203 by, e.g., adhesion. The detection filler 205 has one end portion pivotably supported on a support shaft 206 and is urged toward the tank case 201.

As a result, the detection filler 205 displaces with the motion of the flexible film 203. The displacement amount of the detection filler 205 is detected with a detection sensor 301 that is an optical sensor disposed at the main unit of the image forming apparatus, thus allowing detection of the remaining amount of ink in the head tank 35.

A supply port portion 209 is disposed at an upper portion of the tank case 201 and connected to the supply tube 36 to deliver ink from the ink cartridge 10 to the ink accommodation part 202. At a lateral side of the tank case 201 is disposed an air release unit 207 to release air from the interior of the head tank 35 to the atmosphere.

The air release unit 207 has an air release passage 207 communicating with the interior of the head tank 35, a valve member 207*b* to open and close the air release passage 207*a*, and a spring 207*c* to urge the valve member 207*b* into a closed state. An air release pin member 302 serving as an air release driving unit is disposed at the main unit 1 of the image forming apparatus, and the valve member 207*b* is pushed with the air release pin member 302 to open the air release passage 207*a*, thus causing the interior of the head tank 35 to be open to the atmosphere (in other words, causing the interior of the head tank 35 to communicate with the atmosphere).

Electrode pins 208*a* and 208*b* are mounted to the head tank 35 to detect the remaining amount of ink in the head tank 35. Because of the conductivity of ink, when ink arrives at the electrode pins 208*a* and 208*b*, electric current can flow between the electrode pins 208*a* and 208*b*, thus causing a change in the resistance values of the electrode pins 208*a* and 208*b*. Such a configuration can detect that the liquid level of ink has decreased to a threshold level or lower, i.e., the amount of air in the head tank 35 has increased to a threshold amount or more, or the remaining amount of ink in the head tank 35 has decreased to a threshold amount or lower.

Next, an ink supply-and-discharge system of the image forming apparatus is described with reference to FIG. 5.

Figure 5:
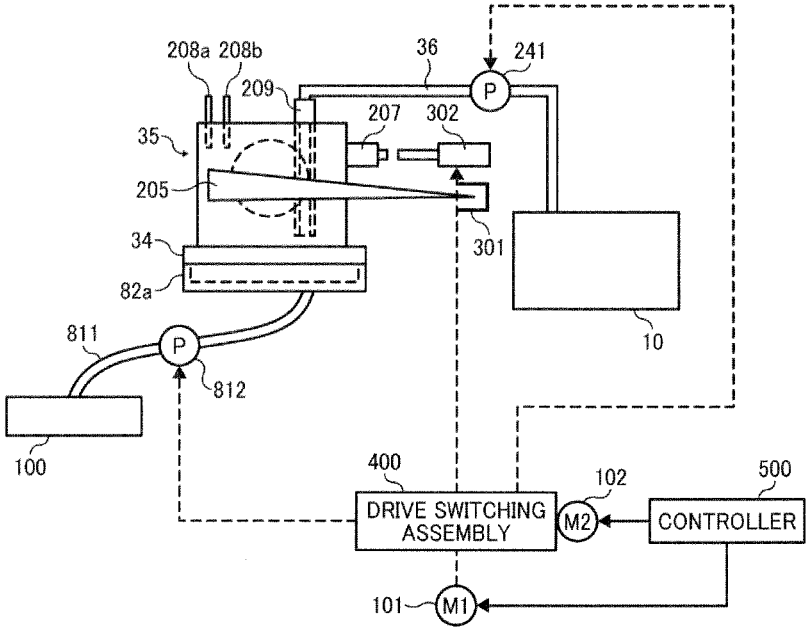
FIG. 5 is a schematic view of an ink supply-and-discharge system of the image forming apparatus.

In FIG. 5, an ink supply system connecting the ink cartridge to the head tank is illustrated for only one color for simplicity. However, it is to be noted that the ink supply system is provided for each of the other colors.

A liquid feed pump 241 serving as a liquid feed unit dedicated for each color is disposed in the supply pump unit 24 to supply ink from the ink cartridge (main tank) 10 to the head tank 35 via the supply tube 36. The liquid feed pump 241 is a bidirectional pump, e.g., a tube pump, capable of performing normal feed operation to supply ink from the ink cartridge 10 to the head tank 35 and reverse feed operation to return ink from the head tank 35 to the ink cartridge 10.

The maintenance unit 81, as described above, has the cap 82*a* to cover the nozzle face of the recording head 34 and a suction pump 812 connected to the cap 82*a*. The suction pump 812 is driven with the nozzle face covered with the cap 82*a* to suck ink from the nozzles via a suction tube 811, thus allowing ink to be sucked from the head tank 35. The ink sucked from the head tank 35 is discharged as waste ink to the waste liquid tank 100.

At the main unit 1 of the image forming apparatus, the air release pin member 302 serving as an air release driving unit (pressing member) is disposed to open and close the air release unit 207. By moving the air release pin member 302, the air release unit 207 can be opened. The detection sensor 301 serving as an optical sensor is disposed at the main unit 1 of the image forming apparatus to detect the detection filler 205.

The driving force of a first driving motor 101 (M1 in FIG. 5) serving as a first driving source is selectively transmitted to the liquid feed pumps 241 dedicated for the respective colors, the suction pump 812, and the air release pin member 302 via a drive switching assembly 400. The drive switching assembly 400 is driven with a second driving motor 102 (M2 in FIG. 5) serving as a second driving source (switching drive source). Driving of the first driving motor 101 is controlled with the controller 500.

Next, an example of a tube pump used as the liquid feed pump 241 and the suction pump 812 is described with reference to FIG. 6.

Figure 6:
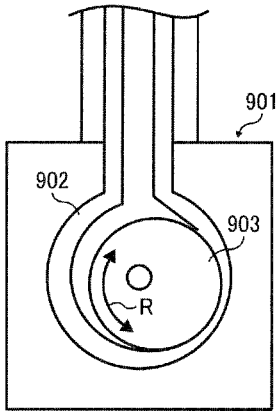
FIG. 6 is a schematic view of an example of a tube pump usable as a liquid feed pump and a suction pump of the image forming apparatus.

A tube pump 901 can transfer liquid through a tube 902 while compressing the tube 902 by an eccentric pressing roller 903 bidirectionally rotatable as indicated by an arrow R in FIG. 6.

In a case where the tube pump 901 is used as the liquid feed pump 241, rotating the pressing roller 903 in respective directions indicated by the arrow R allows ink to be fed from the ink cartridge 10 to the head tank 35 and in reverse from the head tank 35 to the ink cartridge 10. In a case where the tube pump 901 is used as the suction pump 812, rotating the pressing roller 903 in one direction allows ink to be sucked from the nozzles.

Next, an example of the controller of the image forming apparatus is described with reference to FIG. 7.

Figure 7:
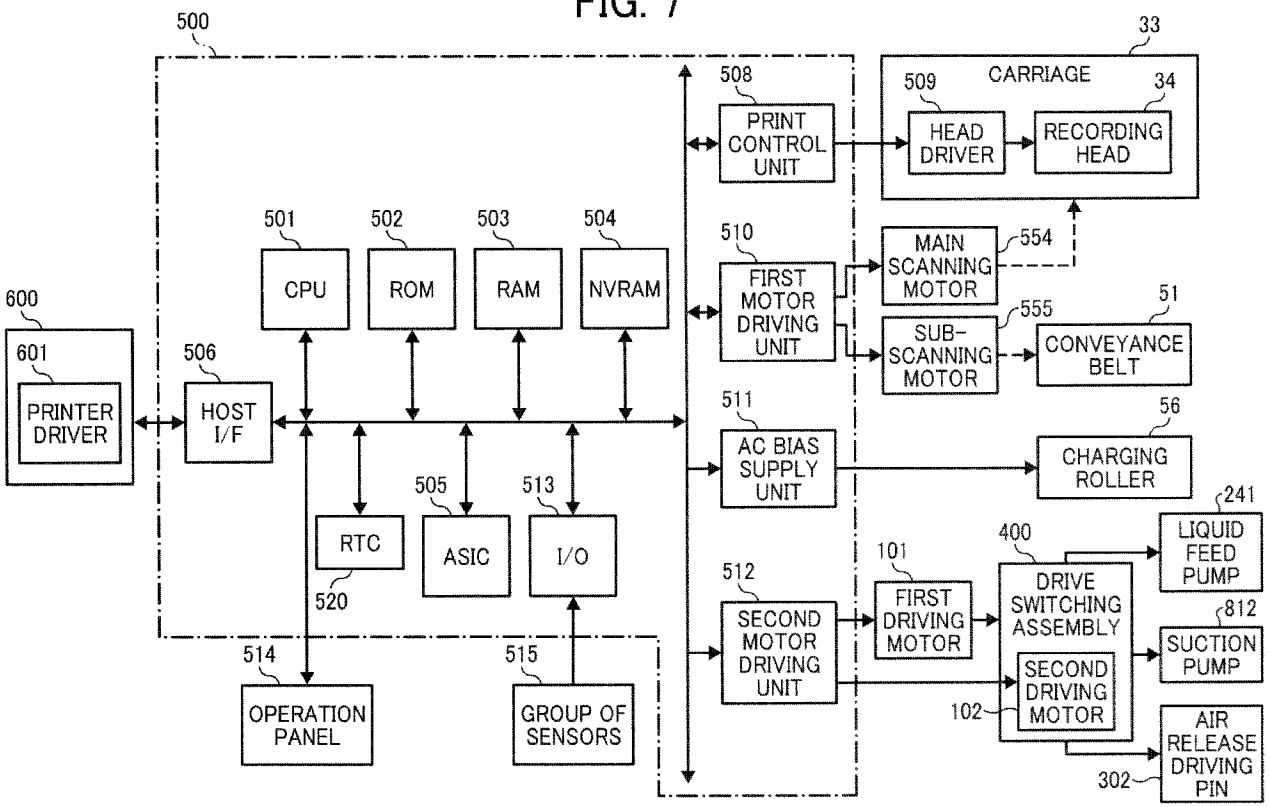
FIG. 7 is a schematic block diagram of a controller of the image forming apparatus.

FIG. 7 is a block diagram of a controller 500 of the image forming apparatus. The controller 500 includes a central processing unit (CPU) 501, a read-only memory (ROM) 502, a random access memory (RAM) 503, a non-volatile memory 504, and an application-specific integrated circuit (ASIC) 505. The CPU 501 manages the control of the entire image forming apparatus. The ROM 502 stores programs executed by the CPU 501 or other fixed data, and the RAM 503 temporarily stores image and other data. The non-volatile memory 504 is a rewritable memory capable of retaining data even when the apparatus is powered off. The ASIC 505 processes various signals on image data, performs sorting or other image processing, and processes input and output signals to control the entire apparatus.

The controller 500 also includes a print control unit 508, a head driver (driver integrated circuit) 509, a main scanning motor 554, a sub-scanning motor 555, a first motor driving unit 510, an alternating current (AC) bias supply unit 511, and a second motor driving unit 512. The print control unit 508 includes a data transfer section and a driving signal generating section to drive and control the recording heads 34. The head driver 509 is disposed at the carriage 33 to drive the recording heads 34. The main scanning motor 554 moves the carriage 33 for scanning, and the sub-scanning motor 555 circulates the conveyance roller 51. The first motor driving unit 510 drives the main scanning motor 554 and the sub-scanning motor 555. The AC bias supply unit 511 supplies an AC bias to the charging roller 56. The second motor driving unit 512 drives the first driving motor 101 and the second driving motor 102 of the drive switching mechanism 600.

The controller 500 is connected to an operation panel 514 for inputting and displaying information necessary to the image forming apparatus.

The controller 500 includes a host interface (I/F) 506 for transmitting and receiving data and signals to and from a host 600, such as an information processing device (e.g., personal computer), image reading device (e.g., image scanner), or imaging device (e.g., digital camera), via a cable or network.

The CPU 501 of the controller 500 reads and analyzes print data stored in a reception buffer of the host I/F 506, performs desired image processing, data sorting, or other processing with the ASIC 505, and transfers image data to the head driver 509. It is to be noted that dot-pattern data for image output may be created by a printer driver 601 of the host 600.

The print control unit 508 transfers the above-described image data as serial data, and outputs to the head driver 509, for example, transfer clock signals, latch signals, and control signals required for the transfer of image data and determination of the transfer. In addition, the print control unit 508 has a driving signal generating section including, e.g., a digital/analog (D/A) converter (to perform digital/analog conversion on pattern data of driving pulses stored on the ROM 502), a voltage amplifier, and a current amplifier, and outputs a driving signal containing one or more driving pulses to the head driver 509.

In accordance with serially-inputted image data corresponding to one image line recorded by the recording heads 34, the head driver 509 selects driving pulses forming driving signals transmitted from the print control unit 508 and applies the selected driving pulses to driving elements (e.g., piezoelectric elements) to drive the recording heads 34. At this time, the driving elements serve as pressure generators to generate energy for ejecting liquid droplets from the recording heads 34. By selecting a part or all of the driving pulses forming the driving signals, the recording heads 34 can selectively eject different sizes of droplets, e.g., large droplets, middle droplets, and small droplets to form different sizes of dots on a recording medium.

An input/output (I/O) unit 513 obtains information from a group of sensors 515 mounted in the image forming apparatus, extracts information required for controlling printing operation, and controls the print control unit 508, the first motor driving unit 510, and the AC bias supply unit 511 based on the extracted information. The group of sensors 515 includes, for example, an optical sensor to detect the position of the sheet of recording media, a thermistor to monitor temperature and/or humidity in the apparatus, a voltage sensor to monitor the voltage of a charging belt, and an interlock switch to detect the opening and closing of a cover. The I/O unit 513 processes information from such various types of sensors. Additionally, information of the above-described electrode pins 208*a* and 208*b* and the detection sensor 301 to detect the detection filler 205 of the head tank 35 are input to the I/O unit 513. The controller 500 also has a timer 520 to measure time.

Next, a drive switching assembly in a first exemplary embodiment of the present disclosure is described with reference to FIGS. 8 to 11.

Figure 8:
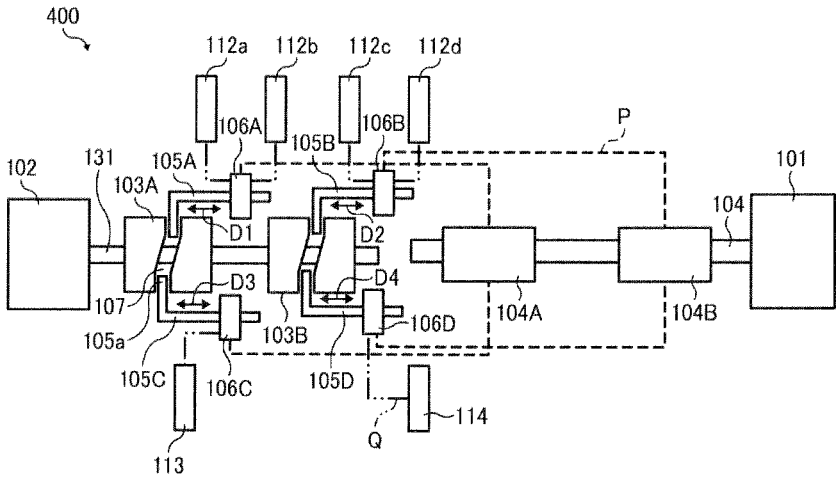
FIG. 8 is a diagram of a drive switching assembly in a first exemplary embodiment of the present disclosure.
Figure 9:
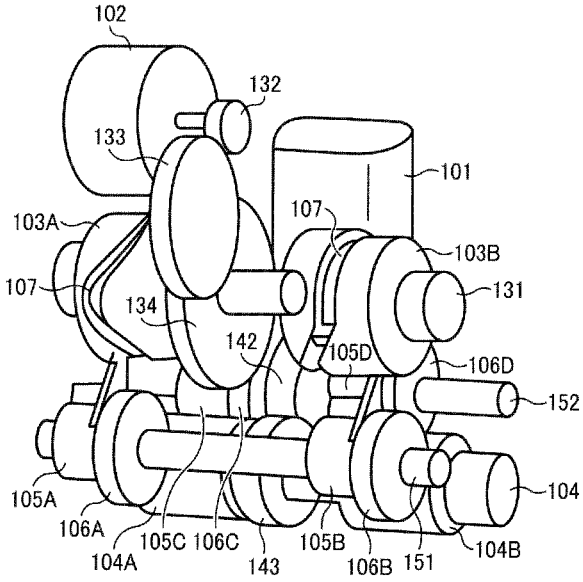
FIG. 9 is a perspective view of the drive switching assembly of FIG. 8.

FIG. 8 is a schematic view of a drive switching assembly 400 in the first exemplary embodiment. FIG. 9 is a perspective view of the drive switching assembly 400.

Figure 10:
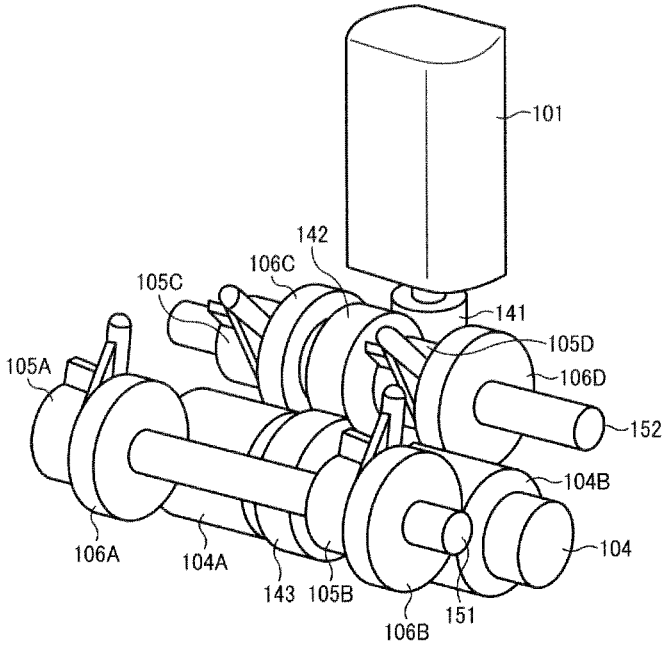
FIG. 10 is a perspective view of the drive switching assembly from which a cam section is removed for ease of view.
Figure 11:
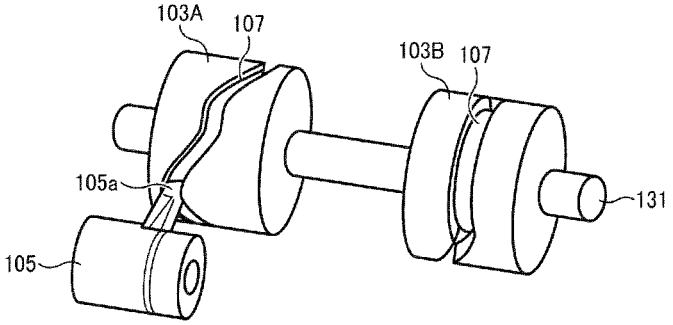
FIG. 11 is a perspective view of cams and a slider member of the drive switching assembly.

FIG. 10 is a perspective view of the drive switching assembly 400 from which a cam section is removed for ease of view. FIG. 11 is a perspective view of cams and a slider member.

In FIG. 8, broken lines P indicate a relationship in which two gears constantly engage with each other, and chain double-dashed lines Q indicate a relationship in which two gears detachably engage with each other. The same goes for the following drawings.

In the drive switching assembly 400, gears 104A and 104B are mounted on a driving shaft 104 rotated by the first driving motor 101.

Cams 103A and 103B (hereinafter, referred to as "cams 103" unless distinguished) are mounted on a cam shaft 131 rotated by the second driving motor 102 of the drive switching assembly 400. Each of the cams 103A and 103B has a cam groove 107.

The drive switching assembly 400 also has slider members 105A to 105D (hereinafter, referred to as "slider members 105" unless distinguished). Each of the slider members 105A to 105D has an engagement portion 105*a* to engage the cam groove 107 of the cam 103A or 103B and is moved along a thrust direction indicated by each of arrows D1 to D4 in FIG. 8 with rotation of the cam 103A or 103B.

In FIG. 8, the engagement portions 105*a* of the slider members 105 are detached from the cam grooves 107 of the cams 103 for ease of view. However, actually, as described above, the engagement portions 105*a* of the slider members 105 slidably contact the cam grooves 107 of the cams 103.

On the slider member 105A is rotatably mounted a switching gear 106A that engages the gear 104A rotated by the first driving motor 101. On the slider member 105B is rotatably mounted a switching gear 106B that engages the gear 104B rotated by the first driving motor 101.

On the slider member 105C is rotatably mounted a switching gear 106C that engages the gear 104A rotated by the first driving motor 101. On the slider member 105D is rotatably mounted a switching gear 106D that engages the gear 104B rotated by the first driving motor 101.

Movement of the slider member 105A causes the switching gear 106A to move between an engagement position to engage either a driving gear 112*a* of a liquid feed pump 241 for, e.g., a first color or a driving gear 112*b* of a liquid feed pump 241 for, e.g., a second color and a disengagement (separate) position to disengage (separate) from any of the driving gears 112*a* and 112*b*.

Movement of the slider member 105B causes the switching gear 106B to move between an engagement position to engage either a driving gear 112*c* of a liquid feed pump 241 for, e.g., a third color or a driving gear 112*d* of a liquid feed pump 241 for, e.g., a fourth color and a disengagement (separate) position to disengage (separate) from any of the driving gears 112*c* and 112*d*.

Movement of the slider member 105C causes the switching gear 106C to move between an engagement position to engage a driving gear 113 of the suction pump 812 of the maintenance unit 81 and a disengagement (separate) position to disengage (separate) from the driving gear 113.

Movement of the slider member 105D causes the switching gear 106D to move between an engagement position to engage a driving gear 114 for reciprocally moving the air release pin member 302 and a disengagement (separate) position to disengage (separate) from the driving gear 114.

In this exemplary embodiment, each of the switching gears 106A and 106B serves as a first switching gear, the switching gear 106C serves as a second switching gear, and the switching gear 106D serves as a third switching gear. The first to fourth colors of inks supplied from the four liquid feed pumps 241 are, e.g., black, cyan, magenta, and yellow.

In the configuration illustrated in FIGS. 9 to 11, the driving force of the first driving motor 101 is transmitted to the driving shaft 104 via a motor gear 141, a gear 142 rotatably mounted on a support shaft 152, and a gear 143 fixed on the driving shaft 104. The driving force of the second driving motor 102 serving as a switching drive source is transmitted to the cam shaft 131 via a motor gear 132, a gear 133, and a gear 134 fixed on the cam shaft 131. The slider member 105A, the switching gear 106A, the slider member 105B, and the switching gear 106B are supported on a support shaft 151. The slider member 105C, the switching gear 106C, the switching gear 105D, and the slider member 106D are supported on a support shaft 152.

For such a configuration, driving the first driving motor 101 causes the driving force to be transmitted to the first switching gears 106A and 106B, the second switching gear 106C, and the third switching gear 106D via the gears 104A and 104B, thus rotating the switching gears 106A to 106D.

When the cams 103A and 103B are rotated by driving the second driving motor 102, the slider members 105A to 105D move along the respective directions indicated by the arrows D1 to D4 in FIG. 8, and the first switching gears 106A and 106B, the second switching gear 106C, and the third switching gear 106D also move along the respective directions indicated by the arrows D1 to D4 in FIG. 8.

When the first switching gear 106A moves to the position to engage the driving gear 112*a*, the liquid feed pump 241 for the first color is driven. Likewise, when the first switching gear 106A moves to the position to engage the driving gear 106B, the liquid feed pump 241 for the second color is driven.

When the slider member 105B moves along the direction indicated by the arrow D2 and the first switching gear 106B moves to the position to engage the driving gear 112*c*, the liquid feed pump 241 for the third color is driven. Likewise, when the first switching gear 106B moves to the position to engage the driving gear 112*d*, the liquid feed pump 241 for the fourth color is driven.

When the slider member 105C moves along the direction indicated by the arrow D3 and the second switching gear 106C moves to the position to engage the driving gear 113, the suction pump 812 of the maintenance unit 81 is driven.

When the slider member 105D moves along the direction indicated by the arrow D4 and the third switching gear 106D moves to the position to engage the driving gear 114, the air release pin member 302 is driven for reciprocal movement.

For such a configuration, as the first driving motor 101 rotates in any of clockwise and counterclockwise directions, the driving force of the first driving motor 101 is transmitted to the liquid feed pumps 241, thus allowing the liquid feed pumps 241 to be driven in any of the normal feed direction (normal rotation direction) and the reverse feed direction (reverse rotation direction).

It is to be noted that the configuration of the drive switching assembly is not limited to the above-described configuration. For example, by adjusting the phases of the cam grooves 107 of the cams 103A and 103B or connecting a plurality of slider members 105 to the cams 103A and 103B at different phases, the switching gears 106A to 106D may be switched in turn with rotation of the cams 103A and 103B or, by contrast, may be simultaneously coupled with a plurality of driving gears.

Using a plurality of cams (in this example, two cams) can reduce the distance at which one cam moves the switching gear, thus resulting in a reduced diameter of the cam. Additionally, using the plurality of cams allows, for example, five or more switching gears to be arranged in the thrust direction (axial direction) without changing dimensions in directions other than the thrust direction.

As described above, the image forming apparatus according to this exemplary embodiment includes a first driving source to drive a plurality of liquid feed pumps and a drive switching assembly to selectively transmit the driving force of the first driving source to the plurality of liquid feed pumps. The drive switching assembly has a second driving source, cams rotated by the second driving source, slider members moved along the thrust direction with rotation of the cams, and first switching gears that receives the driving force of the first driving source and is moved between engagement positions to engage driving gears of the plurality of liquid feed pumps and a disengagement position to disengage from any of the driving gears. By moving the first switching gears, the driving force of the first driving source is selectively transmitted to the plurality of liquid feed pumps. Since the driving source of the pumps is separated from the driving force of the drive switching assembly, such a configuration allows the plurality of pumps to be driven by a small number of driving sources with a relatively high degree of freedom.

In other words, use of the drive switching assembly according to this exemplary embodiment allows the normal and reverse rotation of the first driving source to be transmitted independent of the driving gears of other pumps and units. Thus, as with a configuration in which a single driving source is used, use of the drive switching assembly allows relatively free operation without constraints from other pumps and units.

Next, a drive switching assembly in a second exemplary embodiment of the present disclosure is described with reference to FIGS. 12 and 13.

Figure 12:
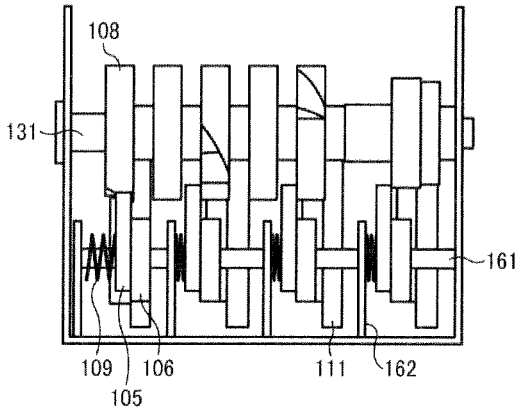
FIG. 12 is a front view of a drive switching assembly in a second exemplary embodiment.
Figure 13:
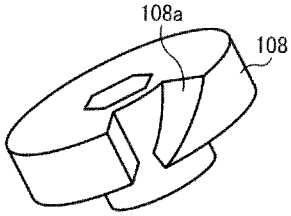
FIG. 13 is a perspective view of a cam of the drive switching assembly of FIG. 12.

FIG. 12 is a front view of the drive switching assembly. FIG. 13 is a perspective view of a cam of the drive switching assembly.

In this exemplary embodiment, four slider members 105 and four switching gears 106 are supported on a support shaft 161 so as to be movable in predetermined ranges. Springs 109 are disposed between the slider members 105 and support plates 162 to urge the slider members 105.

Four cams 108 are fixed on a cam shaft 131 rotated by a second driving source and arranged in the axial direction of the cam shaft 131. The cam 108 has a recessed portion 108*a* into which an engagement portion 105*a* of the slider member 105 can fit.

For such a configuration, when the cam shaft 131 is rotated by the second driving source with the engagement portion 105*a* of the slider member 105 contacting a side face of the cam 108, the cam 108 rotates and the engagement portion 105*a* of the slider member 105 fits into the recessed portion 108*a* of the cam 108. As a result, the slider member 105 is moved in a thrust direction (axial direction of the support shaft 161) by urging force of the spring 109.

When the engagement portion 105*a* of the slider member 105 fits into the recessed portion 108*a* of the cam 108 (e.g., the state of the leftmost one of the slider members 105 in FIG. 12), the switching gear 106 moves in the thrust direction along with the slider member 105 and engages a driving gear 111 of a corresponding liquid feed pump 241.

By contrast, in a case where the engagement portion 105*a* of the slider member 105 has already fitted in the recessed portion 108*a* of the cam 108, the engagement portion 105*a* separates from the recessed portion 108*a* with rotation of the cam 108. As a result, the switching gear 106 moves in the thrust direction along with the slider member 105 and separates from the driving gear 111 of the corresponding liquid feed pump 241.

Such a configuration allows the switching gears 106 to in turn engage and separate from the driving gears 111 of the plurality of liquid feed pumps with rotation of the cams 108, thus allowing selective transmission of the driving force to the plurality of liquid feed pumps.

For such a configuration, the slider member 105 is pressed against the side face of the cam 108 with the spring 109. As a result, even if teeth of the switching gear 106 do not engage teeth of the driving gear 111 well in connecting the switching gear 106 to the driving gear 111, the spring 109 contracts to prevent the second driving source for rotating the cam 108 from losing synchronization due to inadequate engagement of the switching gear 106 with the driving gear 111.

Next, a drive switching assembly in a third exemplary embodiment of the present disclosure is described with reference to FIG. 14.

Figure 14:
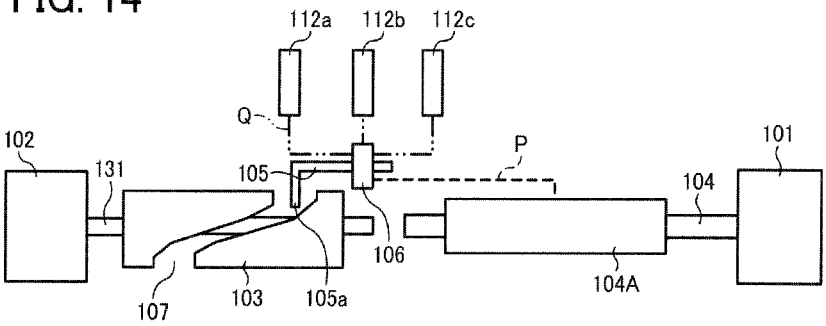
FIG. 14 is a schematic view of a drive switching assembly in a third exemplary embodiment.

FIG. 14 is a schematic view of the drive switching assembly. In this exemplary embodiment, a slider member 105 is moved with a single cam 103 along a thrust direction to move a switching gear 106 in thrust direction. As a result, the switching gear 106 selectively engages three driving gears 112*a* to 112*c* to transmit the driving force of the first driving motor 101 to any one of the driving gear 112*a* to 112*c*.

Such a configuration allows transmission of the driving force to be switched with a single switching gear without using two opposed switching gears as described in the above-described exemplary embodiments. In this case, however, the gradient of a cam groove 107 in the cam 103 is preferably small to move the slider member 105 smoothly, resulting in an increased diameter of the cam 103.

Next, a drive switching assembly in a fourth exemplary embodiment of the present disclosure is described with reference to FIGS. 15A and 15B.

Figure 15A:
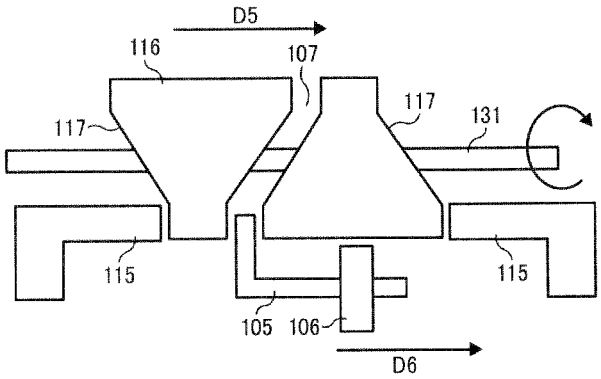
FIGS. 15A and 15B are schematic views of different states of a drive switching assembly in a fourth exemplary embodiment.
Figure 15B:
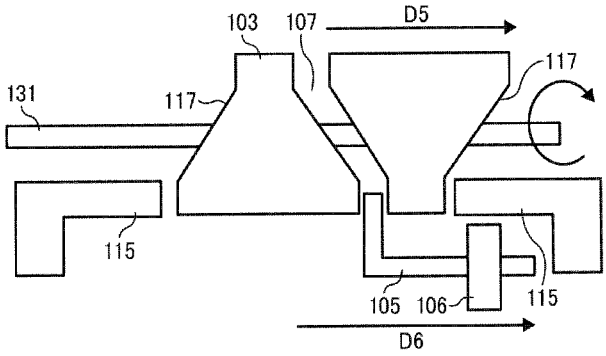

FIGS. 15A and 15B are schematic views of different states of the drive switching assembly in the fourth exemplary embodiment. In this exemplary embodiment, cams themselves are movable on cam shafts. In other words, as illustrated in FIGS. 15A and 15B, a moving cam 116 is movable in the axial direction of a cam shaft 131 rotated by a second driving motor and rotatable with the cam shaft 131 in a rotation direction of the cam shaft 131.

The moving cam 116 is cylindrical, and has a cam groove 107 at an inner side and cam faces 117 at both ends in the axial direction of the cam shaft. The cam groove 107 has a cam curve along the outer circumference of the moving cam 116, and each cam face 117 has a cam curve along the outer circumference.

Outside both edges of the moving cam 116 in the axial direction, holder rib 115 are fixed so as to slidably contact the cam faces 117 of the moving cam 116, thus positioning the moving cam 116 with respect to a thrust direction indicated by an arrow D5 in FIGS. 15A and 15B.

For such a configuration, as the cam shaft 131 is rotated by a second driving motor to rotate the moving cam 116, a slider member 105 moves in a thrust direction indicated by an arrow D6 in FIGS. 15A and 15B with an engagement portion 105*a* thereof engaging the cam groove 107 of the moving cam 116. Simultaneously, the moving cam 116 moves in the thrust direction D5 along the cam faces 117 of both edges of the moving cam 116.

As the moving cam 116 rotates, the drive switching assembly shifts from, e.g., a state illustrated in FIG. 15A to a state illustrated in FIG. 15B. The slider member 105 relatively moves by a total of a moving amount of the slider member 105 along the cam groove 107 and a moving amount of the moving cam 116 along the cam faces 117.

Such a configuration can increase the moving amount of the slider member by the amount in which the moving cam 116 moves along the cam faces 117, as compared with a drive switching assembly having cam grooves of the same diameter and the same gradient as described in the first exemplary embodiment. In this configuration, since the gradient of the cam groove 107 is invariant, the slider member 105 can move smoothly and obtain a relatively large moving amount of the slider member with a relatively small cam size.

Next, a drive switching assembly in a fifth exemplary embodiment of the present disclosure is described with reference to FIGS. 16A and 16B.

Figure 16A:
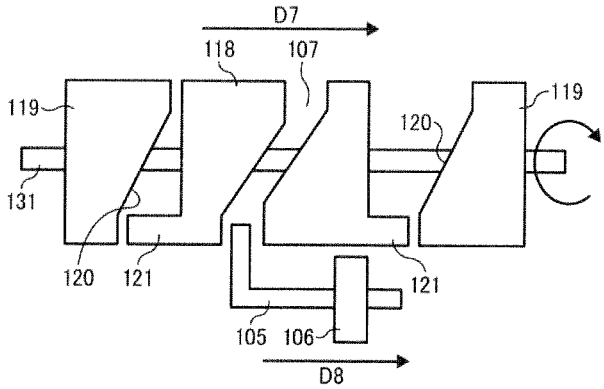
FIGS. 16A and 16B are schematic views of different states of a drive switching assembly in a fifth exemplary embodiment
Figure 16B:
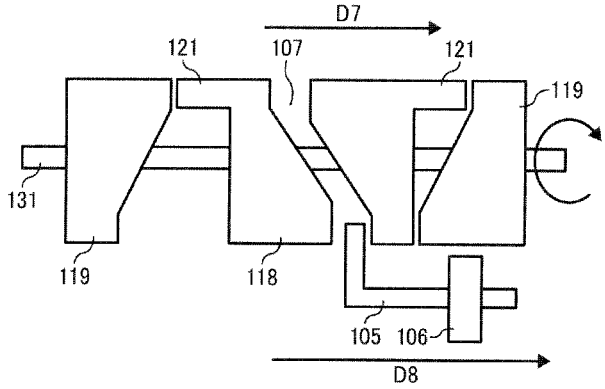

FIGS. 16A and 16B are schematic views of different states of the drive switching assembly in the fifth exemplary embodiment. In this exemplary embodiment, cams themselves are movable on cam shafts like the fourth exemplary embodiment. In other words, as illustrated in FIGS. 16A and 16B, a moving cam 118 is movable in the axial direction of a cam shaft 131 rotated by a second driving motor and rotatable with the cam shaft 131 in a rotation direction of the cam shaft 131.

Outside both edges of the moving cam 118 in the axial direction, fixed cams 119 having cam faces 120 opposing both edge faces of the moving cam 118 are disposed. The moving cam 118 has a cam groove 107 at an inner side and ribs 121 at both ends in the axial direction of the cam shaft. The cam groove 107 has a cam curve along the outer circumference of the moving cam 118, and the ribs 121 slidably contact the respective cam faces 120 of the fixed cams 119.

For such a configuration, as a cam actuator shaft 131 is rotated by a second driving motor to rotate the moving cam 118, a slider member 105 moves in a thrust direction (indicated by an arrow D7 in FIGS. 16A and 16B) with an engagement portion 105*a* thereof engaging the cam groove 107 of the moving cam 118. Simultaneously, the ribs 121 of both edges of the moving cam 118 move along the cam faces 120 of the fixed cams 119, thus moving the moving cam 118 in a thrust direction indicated by an arrow D8 in FIGS. 16A and 16B.

As the moving cam 118 rotates, the drive switching assembly shifts from, e.g., a state illustrated in FIG. 16A to a state illustrated in FIG. 16B. The slider member 105 relatively moves by a total of a moving amount of the slider member 105 along the cam groove 107 and a moving amount of the moving cam 118 along the cam faces 120. Such a configuration can obtain effects equivalent to those of the above-described fourth exemplary embodiment.

Next, a drive switching assembly in a sixth exemplary embodiment of the present disclosure is described with reference to FIG. 17.

Figure 17:
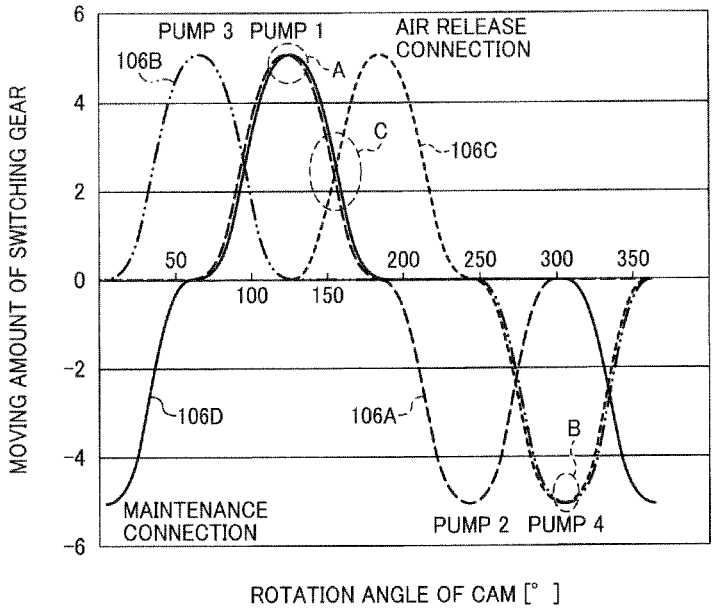
FIG. 17 is a chart showing relations between rotation angle of cams and moving amount of switching gears in a drive switching assembly in a sixth exemplary embodiment.

FIG. 17 is a chart showing relations between the rotation angle of cams and the moving amount of switching gears in the drive switching assembly.

In this exemplary embodiment, the configuration of the above-described first exemplary embodiment is modified so that, by changing the phases of the switching gears 106A to 106D, the switching gears 106A to 106D are in turn connected once to the driving gears 112*a* to 112*d*, the driving gear 113, and the driving gear 114 during every rotation of the cams 103A and 103B. Such a configuration allows the driving gears 112*a* to 112*d* to drive independently of one another.

As shown in FIG. 17, in a region A in which the driving gear 112*a* of the liquid feed pump 241 (pump 1 in FIG. 17) is connected to the switching gear 106A, the driving gear 113 of the maintenance unit moves to an area away from the switching gear 106D to turn into a free state. In a region B in which the driving gear 112*d* of the liquid feed pump 241 (pump 4 in FIG. 17) is connected to the switching gear 106B, the driving gear 114 of the air release pin member 302 moves to an area away from the switching gear 106C to turn into a free state.

In a region C, even if the switching gears 106A and 106C are connected to the driving gear 112*a* and 113, respectively, switching operation can be performed when the first driving motor 101 is stopped. Thus, the gradient of cam line graphs (the cam grooves 107) of the cams 103A and 103B can be set to be relatively small.

In other words, switching operation for rotating the cams 103 and transmission operation for transmitting the driving force are performed independent of each other, not simultaneously. Such a configuration can prevent misoperation even if two switching gears are temporarily connected to driving gears at the same time, thus reducing the gradient of each cam line graph.

Since 360 degrees of full rotation are divided by six driving gears, typically, a movement angle of 60 degrees is allocated to each of the switching gears 106A to 106D. However, as described above, since the first driving source is not driven during movement of the switching gears 106A to 106D, two switching gears may temporarily be connected to driving gears at the same time. Therefore, in FIG. 17, the movement angle of each switching gear is set to be 120 degrees.

Next, a drive switching assembly in a seventh exemplary embodiment of the present disclosure is described with reference to FIGS. 18A and 18B.

Figure 18A:
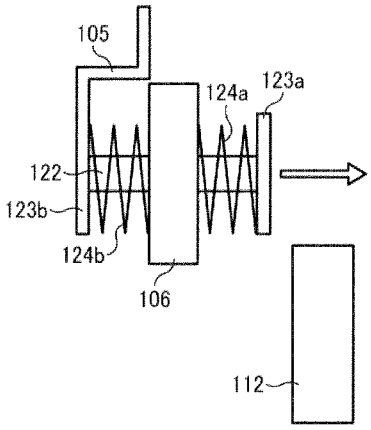
FIGS. 18A and 18B are schematic views of a drive switching assembly in a seventh exemplary embodiment.
Figure 18B:
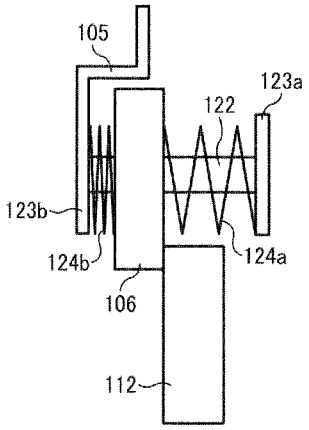

FIGS. 18A and 18B are schematic views of the drive switching assembly. In this exemplary embodiment, switching gears are urged with springs. More specifically, in a drive switching assembly like that of the first exemplary embodiment that moves switching gears with cam grooves to switch driving gears, the switching gears are urged with springs.

In other words, the switching gear 106 is mounted on a shaft 122 of a slider member 105 so as to be slidable in the axial direction of the shaft 122. A spring 124*a* is disposed between a support portion 123*a* at one end of the shaft 122 of the slider member 105 and one end face of the switching gear 106 in the axial direction, and a spring 124*b* is disposed between a support portion 123*b* at the opposite end of the shaft 122 of the slider member 105 and the opposite end face of the switching gear 106 in the axial direction.

For such a configuration, even if teeth of the switching gear 106 conflict with and do not engage teeth of the driving gear 112 when the slider member 105 moves, e.g., from a state illustrated in FIG. 18A to a state illustrated in FIG. 18B, the spring 124*b* contracts to absorb the conflict. Such a configuration prevents excess load on a second driving motor (second driving source) that rotates the cam 103 to move the switching gear 106, thus allowing the driving gears to be switched without loss of synchronization of the second driving motor.

In addition, for such a configuration, the urging force of the spring works only when the switching gear 106 strikes the driving gear 112. Thus, as compared to a case where the switching gear 106 is constantly urged with a spring(s), the load to the second driving source can be reduced.

Next, a drive switching assembly in an eighth exemplary embodiment of the present disclosure is described with reference to FIGS. 19A and 19B.

Figure 19A:
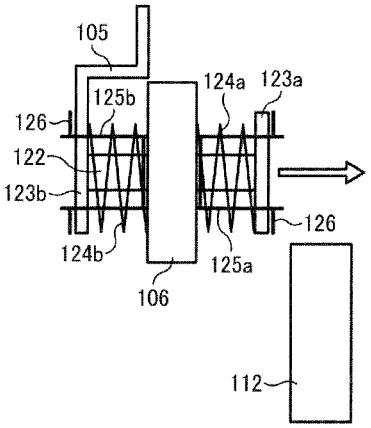
FIGS. 19A and 19B are schematic views of a drive switching assembly in an eighth exemplary embodiment.
Figure 19B:
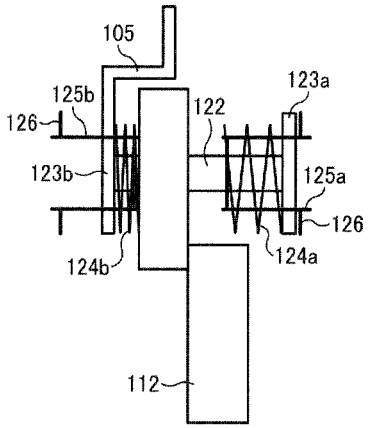

FIGS. 19A and 19B are schematic views of the drive switching assembly. In this exemplary embodiment, the drive switching assembly according to the above-described seventh exemplary embodiment is modified so that the lengths of springs 124*a* and 124*b* in the extending direction are restricted with stoppers 125*a* and 125*b*. The stoppers 125*a* and 125*b* hold front ends of the springs 124*a* and 124*b*, respectively, (at the side proximal to a switching gear 106) and are movable relative to support portions 123*a* and 123*b*, and the maximum movable ranges of the stoppers 125*a* and 125*b* are restricted with rear-end ribs 126.

In other words, for the configuration of the above-described seventh exemplary embodiment, the position of the switching gear 106 may shift in the axial direction due to a difference in urging force between the springs 124*a* and 124*b* at both sides of the switching gear 106. Hence, in this exemplary embodiment, the stoppers 125*a* and 125*b* are disposed to position the switching gear 106 by dimension, thus increasing the positional accuracy. In this configuration, the spring forces of the springs 124*a* and 124*b* do not constantly act on the switching gear 106, thus obtaining a reduced rotation torque of the switching gear 106.

Next, a drive switching assembly in a ninth exemplary embodiment of the present disclosure is described with reference to FIGS. 20A and 20B.

Figure 20A:
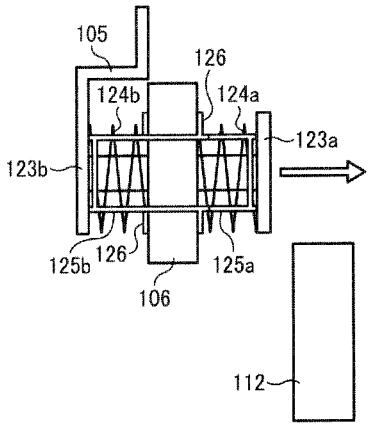
FIGS. 20A and 20B are schematic views of a drive switching assembly in an ninth exemplary embodiment.
Figure 20B:
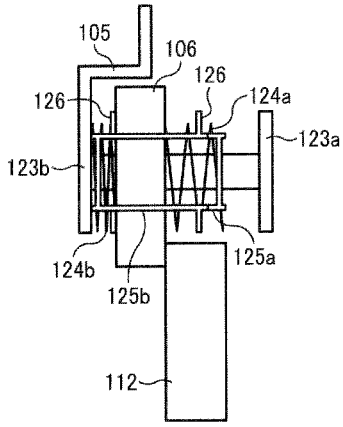

FIGS. 20A and 20B are schematic views of the drive switching assembly. In this exemplary embodiment, the drive switching assembly according to the above-described eighth exemplary embodiment is modified so that stoppers 125*a* and 125*b* are held with a switching gear 106. The stoppers 125*a* and 125*b* hold rear ends of springs 124*a* and 124*b* proximal to support portions 123*a* and 123*b*, respectively, and the switching gear 106 holds front ends of the springs 124*a* and 124*b* distal to the support portions 123*a* and 123*b*, respectively. The stoppers 125*a* and 125*b* are movable relative to the switching gear 106, and the maximum movable ranges of the stoppers 125*a* and 125*b* are restricted by contacting rear-end ribs 126 of the stoppers 125*a* and 125*b* with the switching gear 106.

Next, a drive switching assembly in a tenth exemplary embodiment of the present disclosure is described with reference to FIGS. 21A, 21B, and 21C.

Figure 21A:
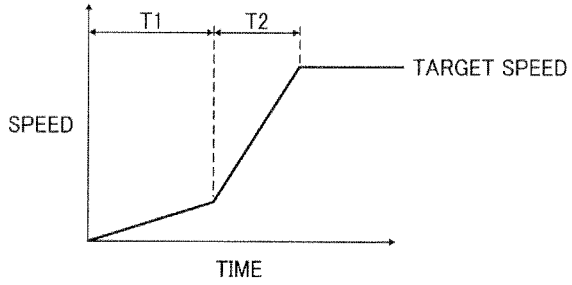
FIGS. 21A to 21C are schematic views of different examples of drive control of a second driving source in a drive switching assembly in a tenth exemplary embodiment.
Figure 21B:
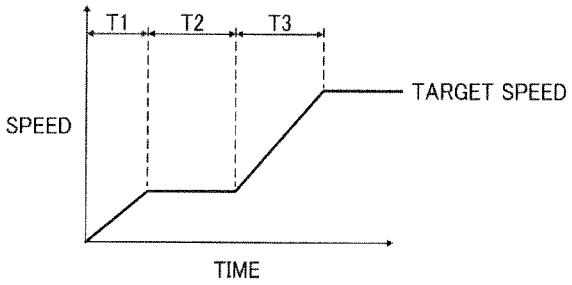
Figure 21C:
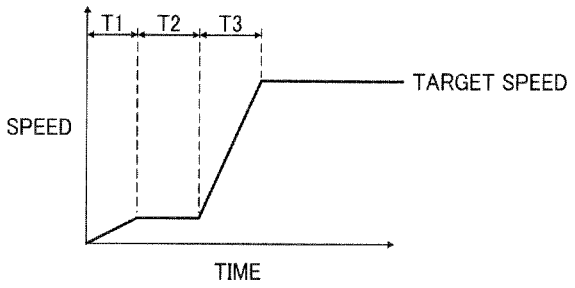

FIGS. 21A to 21C are schematic views of different examples of drive control of a second driving source in the drive switching assembly. In the above-described exemplary embodiments, since switching gears move in the thrust direction to switch driving gears for transmitting the drive force, the teeth of a switching gear might conflict with and not engage the teeth of a driving gear smoothly.

In such a case, as described above, for the exemplary embodiments in which springs (elastic members) are used, the teeth of the switching gear remains unengaged with the teeth of the driving gear until the first driving source is activated. When the first driving source is activated, the urging force of a spring causes the teeth of the switching gear to engage the teeth of the driving gear. However, even in such a configuration, if the urging force of the spring is so weak that, e.g., a time during which the teeth of the switching gear moves by one tooth at an engagement position becomes shorter than a time during which the switching gear is urged with the spring to engage the driving gear, the teeth of the switching gear might be rejected by the teeth of the driving gear, thus hampering smooth engagement of the switching gear with the driving gear.

Hence, for this exemplary embodiment, in a first example illustrated in FIG. 21A, the acceleration of the second driving source is set to be low in a first region T1 and high in a second region T2.

In a second example illustrated in FIG. 21B, the second driving source is rotated at a low speed range in a first region T1 and at a constant speed in a second region T2. In a third region T3, the second driving source is accelerated at the same acceleration as that in the first region T1 to reach a target speed.

In a third example illustrated in FIG. 21C, the first example is combined with the second example. In other words, the second driving source is driven at a low speed range in a first region T1 and at a constant speed in a second region T2. In a third region T3, the second driving source is accelerated at an acceleration higher than that in the first region T1 to reach a target speed. In other words, at least while the teeth of the switching gear moves by half of one tooth, the speed of the second driving motor is maintained at such a speed that the teeth of the switching gear can engage the teeth of the driving gear. Then, the speed of the second driving motor is increased to a target speed. Such drive control allows more reliable engagement of the switching gear with the driving gear.

Next, a drive switching assembly in an eleventh exemplary embodiment of the present disclosure is described with reference to FIGS. 22A and 22B.

Figure 22A:
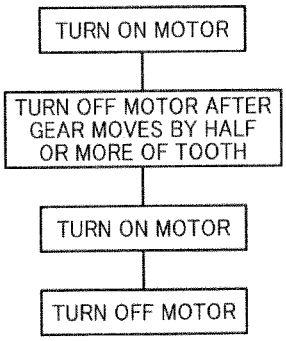
FIGS. 22A and 22B are flow charts of different examples of drive control of a second driving source in a drive switching assembly in an eleventh exemplary embodiment.
Figure 22B:
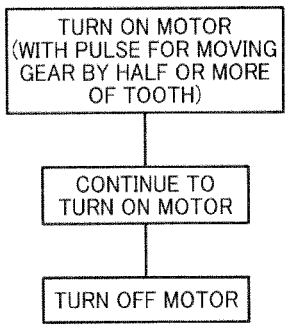

FIGS. 22A and 22B are flow charts of different examples of drive control of a second driving source in the drive switching assembly.

In a first example illustrated in FIG. 22A, when a switching gear 106 moves by half of a tooth after the turning on of a second driving motor 102, the second driving motor 102 is temporarily turned off. Then, the second driving motor 102 is turned on, and after the switching gear 106 moves by a desired amount, the second driving motor 102 is turned off In the above-described exemplary embodiments in which springs are used, if the switching gear 106 conflict with the driving gear 112, by moving the switching gear 106 at half of a tooth and stopping it, the switching gear 106 securely engages the driving gear 112 or other gear by the urging force of the spring. Thus, after the switching gear 106 is rotated at half of a tooth and temporarily stopped, the drive control for desired operation is performed, thus reliably engaging the switching gear with the driving gear.

In a second example illustrated in FIG. 22B, the second driving motor 102 is turned on with a pulse for moving the switching gear 106 by half or more of a tooth. The turning-on state is maintained until a desired moving amount of the switching gear 106 is obtained. When the desired moving amount is obtained, the second driving motor 102 is turned off. For the drive control for rotating the switching gear 106 by half or more of a tooth, the driving of the switching gear 106 is controlled with zero or several teeth plus half of a tooth to reliably shift the phase of teeth, thus more securely engaging the switching gear 106 with the driving gear 112.

Next, a drive switching assembly in a twelfth exemplary embodiment of the present disclosure is described with reference to FIG. 23.

Figure 23:
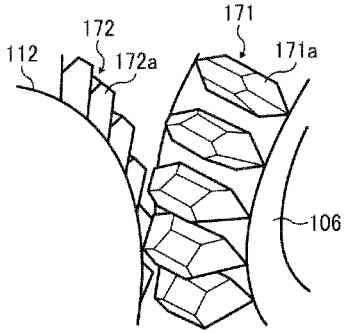
FIG. 23 is a perspective view of shapes of gears of a drive switching assembly in a twelfth exemplary embodiment.

FIG. 23 is a perspective view of shapes of gears of the drive switching assembly in the twelfth exemplary embodiment. Teeth 171 of a switching gear 106 and teeth 172 of a driving gear 112 have slant faces 171*a* and 172*b* at opposed side faces in the thrust direction. In other words, the side faces of the teeth 171 and 172 are chamfered and further processed to have sharp edges.

As a result, when the switching gear 106 engages the driving gear 112 from the thrust direction, the teeth 171 is less likely to conflict with the teeth 172. Thus, the switching gear 106 smoothly engages the driving gear 112, thus preventing loss of synchronization of the second driving source. Alternatively, the shapes of the side faces of the teeth 171 and 172 may be only chamfered or processed to have sharp edges.

In this exemplary embodiment, the gear shape of the driving gear 112 is described. Likewise, the above-described gear shapes can be applied to the shapes of other driving gears.

Next, a drive switching assembly in a thirteenth exemplary embodiment of the present disclosure is described with reference to FIG. 24.

Figure 24:
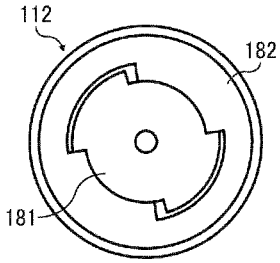
FIG. 24 is a perspective view of a driving gear of a drive switching assembly in a thirteenth exemplary embodiment.

FIG. 24 is a perspective view of a driving gear of the drive switching assembly in the thirteenth exemplary embodiment. A driving gear 112 connectable to a switching gear 106 has a shaft portion 181 and a gear portion 182. The gear portion 182 is mounted on the shaft portion 181 so as to have a play of plus or minus half or more of a tooth relative to the shaft portion 181.

For such a configuration, even if the teeth of the switching gear 106 conflicts with the teeth of the driving gear 112 when the switching gear 106 engages the driving gear 112 from the thrust direction, the play between the shaft portion 181 and the gear portion 182 allows rotation of the driving gear 112. As a result, the switching gear 106 engages the driving gear 112 without striking the driving gear 112, thus preventing loss of synchronization of the second driving source due to an increased load resulting from striking of the switching gear 106 against the driving gear 112 from the thrust direction.

Alternatively, in a case where other gears are connected to a downstream side of the driving gear, one of the other gears may have a gear portion and a shaft portion as described above. Even if the one of the other gears does not directly engage the switching gear, such a configuration can obtain effects equivalent to those of the above-described configuration that the driving gear 112 has the shaft portion 181 and the gear portion 182 with the play.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head to eject droplets of liquids;

a plurality of head tanks to supply the liquids to the recording head;

a plurality of replaceable main tanks to store the liquids to be supplied to the recording head;

a plurality of liquid feed pumps to feed the liquids from the plurality of main tanks to the plurality of head tanks and in reverse from the plurality of head tanks to the plurality of main tanks;

a first driving source to drive the plurality of liquid feed pumps; and a drive switching assembly to selectively transmit a driving force of the first driving source to the plurality of liquid feed pumps, the drive switching assembly including a second driving source, a cam rotated by the second driving source, a slider member movable in a thrust direction with rotation of the cam, and a switching gear to receive the driving force of the first driving source and movable with the slider member between positions to engage driving gears of the plurality of liquid feed pumps and a position to disengage from the driving gears of the plurality of liquid feed pumps, wherein, with movement of the switching gear, the driving force of the first driving source is selectively transmitted to the plurality of liquid feed pumps.

2. The image forming apparatus of claim 1, further comprising a maintenance unit to maintain and recover the recording head, the maintenance unit comprising:

a cap member to cover a nozzle face of the recording head; and a suction pump connected to the cap member, wherein the drive switching assembly includes a second switching gear to receive the driving force of the first driving source and movable with the slider member between a position to engage a driving gear of the maintenance unit and a position to disengage from the driving gear of the maintenance unit.

3. The image forming apparatus of claim 1, wherein each of the plurality of head tanks has an air release unit openable to release air from an interior of the each of the plurality of head tanks to atmosphere, the image forming apparatus further comprises an air release driving unit at a main unit of the image forming apparatus to drive the air release unit, and the drive switching assembly includes a third switching gear to receive the driving force of the first driving source and movable with the slider member between a position to engage a driving gear of the air release unit and a position to disengage from the driving gear of the air release unit.

4. An image forming apparatus comprising:

a recording head to eject droplets of liquids;

a plurality of head tanks to supply the liquids to the recording head;

a plurality of replaceable main tanks to store the liquids to be supplied to the recording head;

a plurality of liquid feed pumps to feed the liquids from the plurality of main tanks to the plurality of head tanks and in reverse from the plurality of head tanks to the plurality of main tanks;

a first driving source to drive the plurality of liquid feed pumps; and a drive switching assembly to selectively transmit a driving force of the first driving source to the plurality of liquid feed pumps, the drive switching assembly including a second driving source, a cam rotated by the second driving source, a slider member movable in a thrust direction with rotation of the cam, and a switching gear to receive the driving force of the first driving source and movable with the slider member between positions to engage driving gears of the plurality of liquid feed pumps and a position to disengage from the driving gears of the plurality of liquid feed pumps, wherein, with movement of the switching gear, the driving force of the first driving source is selectively transmitted to the plurality of liquid feed pumps, and wherein the switching gear selectively engages a plurality of driving gears coaxially arranged.

5. The image forming apparatus of claim 1, wherein the cam and the slider member are provided in a ratio of one to two or more.

6. The image forming apparatus of claim 1, wherein the drive switching assembly further includes an elastic member to urge the switching gear in a direction in which the switching gear moves.

7. The image forming apparatus of claim 6, wherein the elastic member is a spring and the drive switching assembly further includes a stopper to restrict the spring in a direction in which the spring extends.

8. The image forming apparatus of claim 1, wherein each of the driving gears has a shaft portion and a gear portion, and the gear portion is mounted on the shaft portion with a play disposed in a range along a rotation direction of the gear portion.

9. An image forming apparatus comprising:

a recording head to eject droplets of liquids;

a plurality of head tanks to supply the liquids to the recording head;

a plurality of replaceable main tanks to store the liquids to be supplied to the recording head;

a plurality of liquid feed pumps to feed the liquids from the plurality of main tanks to the plurality of head tanks and in reverse from the plurality of head tanks to the plurality of main tanks;

a first driving source to drive the plurality of liquid feed pumps; and a drive switching assembly to selectively transmit a driving force of the first driving source to the plurality of liquid feed pumps, the drive switching assembly including a second driving source, a cam rotated by the second driving source, a slider member movable in a thrust direction with rotation of the cam, and a switching gear to receive the driving force of the first driving source and movable with the slider member between positions to engage driving gears of the plurality of liquid feed pumps and a position to disengage from the driving gears of the plurality of liquid feed pumps, wherein, with movement of the switching gear, the driving force of the first driving source is selectively transmitted to the plurality of liquid feed pumps, and wherein the cam, while rotating, is movable in the thrust direction.

10. The image forming apparatus of claim 1, wherein the second driving source is driven when the first driving source is stopped.

* * * * *